United States Patent [19]

Epstein

[11] 3,968,668

[45] July 13, 1976

[54] PICKPROOF CYLINDER LOCK

[75] Inventor: Norman Epstein, Carmel, N.Y.

[73] Assignee: Norman Lock Co., Mahopac, N.Y.

[22] Filed: Aug. 30, 1974

[21] Appl. No.: 502,034

Related U.S. Application Data

[63] Continuation-in-part of Ser. No. 388,428, Aug. 15, 1973, abandoned.

[52] U.S. Cl. ..... 70/364 A; 70/379 R; 70/386

[51] Int. Cl.[2] ..... E05B 17/04

[58] Field of Search ..... 70/379 R, 379 A, 380, 70/362, 364 A, 419, 386

[56] References Cited

UNITED STATES PATENTS

| | | | |
|---|---|---|---|
| 570,032 | 10/1896 | Luebbers | 70/386 X |
| 1,388,778 | 8/1921 | Smith | 70/237 |
| 3,410,123 | 11/1968 | Jecobi | 70/364 R |
| 3,599,455 | 8/1971 | Pilvet | 70/363 |

*Primary Examiner*—Robert L. Wolfe
*Attorney, Agent, or Firm*—Edward F. Levy

[57] ABSTRACT

A pickproof cylinder lock has a plurality of key-actuatable spring-tensioned pin tumblers wholly received in the cylinder and slidably mounted therein, and a ball connected with each pin to be raised or lowered with the pin. The balls are normally held in inactive positions by their pins, but when a proper key is inserted, the balls are brought into active positions by their pins and form a straight link through which key actuation of the pins is translated into a force on a lock-operating member to move the same to a lock-open position. A spring member normally locks the lock-operating member rigidly in a lock-closed position, and the force produced by the balls in their active position is also directed against the spring member to move the latter to a position in which it releases the lock-operating member. The lock also includes a slidable pin engaging the lock-operating member, which pin coacts with a cam surface on the inserted key, and is pressed by said cam surface against the lock-operating member when the key is withdrawn, to insure that the lock-operating member returns to its lock-closed position.

9 Claims, 9 Drawing Figures

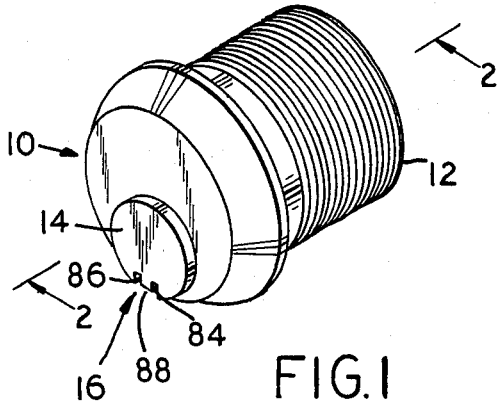
FIG. 1
FIG. 2
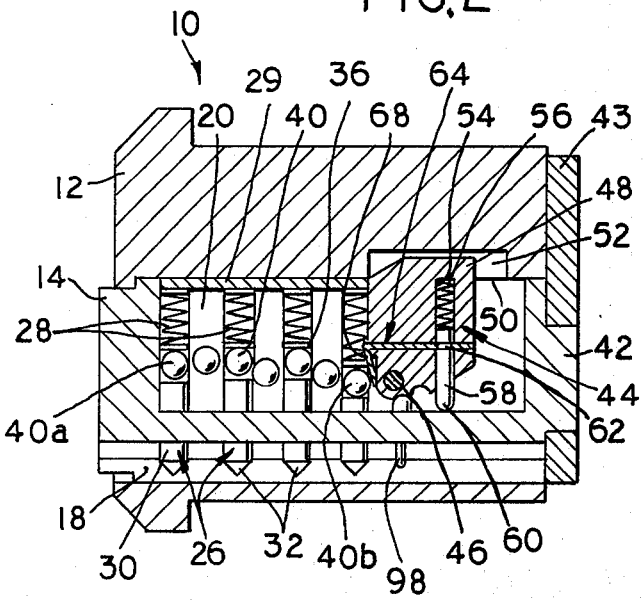
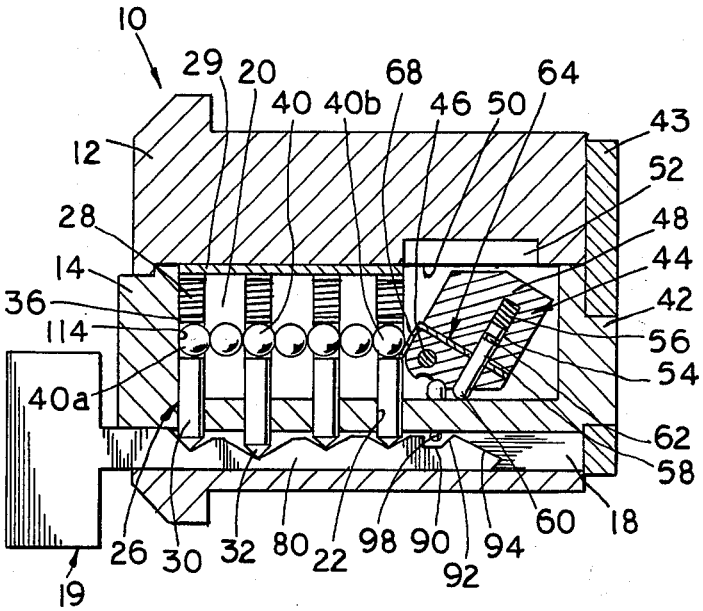
FIG. 3
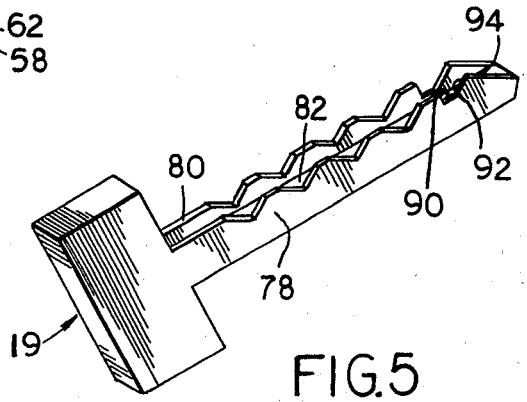
FIG. 5

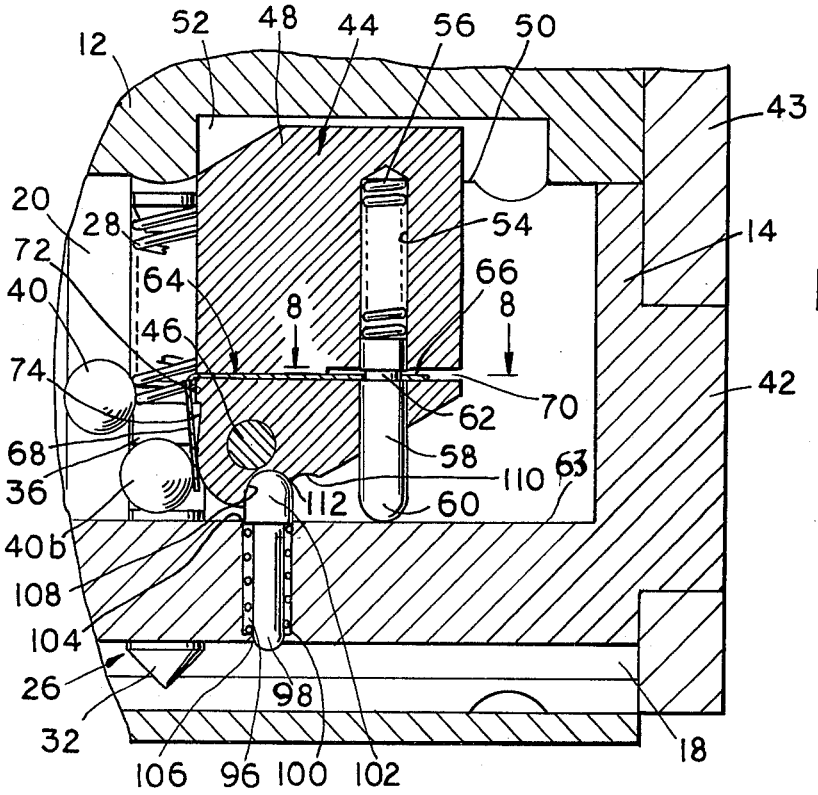
FIG. 6
FIG. 7
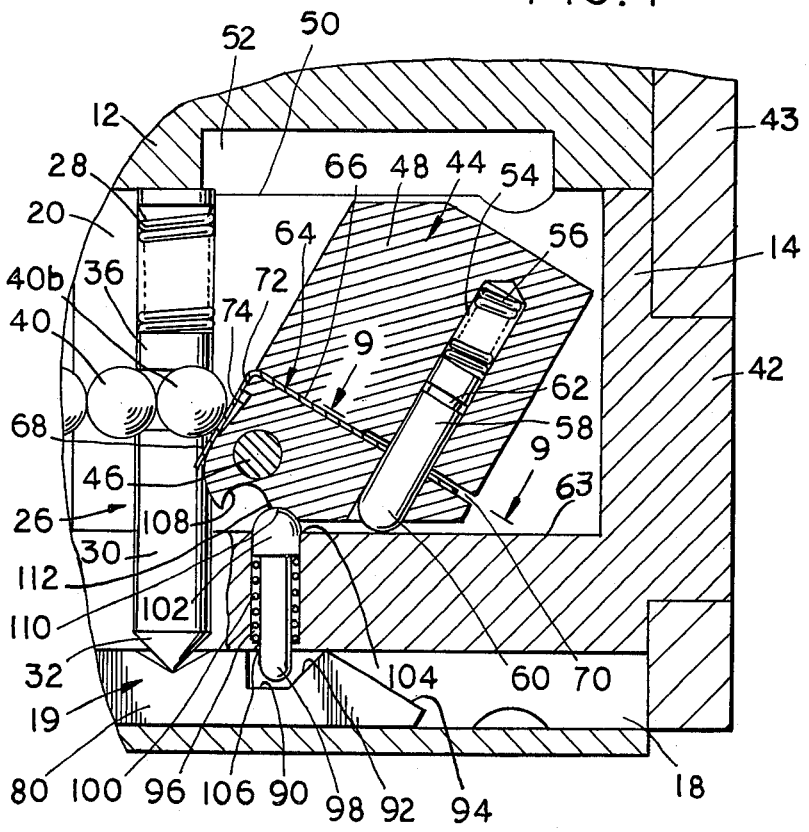
FIG. 8
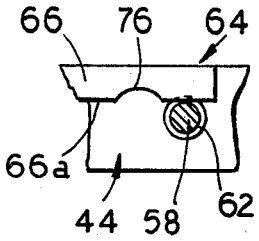
FIG. 9
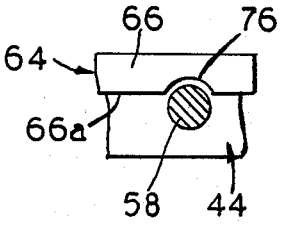

PICKPROOF CYLINDER LOCK

This application is a continuation-in-part of my copending U.S. patent application Ser. No. 388,428 filed Aug. 15, 1973 and now abandoned and entitled "Pickproof Cylinder Lock."

The present invention relates in general to locks and in particular, to a cylinder-type lock which is pickproof. The lock operates on the novel principle of utilizing the tumbler pins to bring a corresponding number of elements, such as balls, into a straight-line chain which transmits a force longitudinally to a pivoting member to produce the opening action.

In my aforementioned patent application Ser. No. 388,428, a pickproof lock is shown comprising a cylinder rotatably mounted in a housing, a lock-operating member movably mounted within the cylinder and normally urged to a first position in which the lock is closed, a plurality of spring-biased tumbler pins slidably mounted wholly within the lock cylinder, and a lock-release element carried by each of said pins and movable therewith. The tumbler pins have a normal lock-closed position in which the lock-release elements are maintained at different levels. The pins are positioned to be engaged by a proper key inserted into the keyway of the lock, and are movable by the fully-inserted key to selected positions in which the lock-release elements are located in a straight line to form a linear chain or link of elements for transmitting a lock-opening force through said cylinder to said lock-operating member, whereby to move the latter to a second lock-opening position.

In a preferred embodiment of the lock, according to the aforesaid application, the lock-release elements are in the nature of small balls which form a chain between the lock-operating member and a fixed portion of the cylinder. When the balls are out of horizontal alignment, the distance from one end of the chain to the other is insufficient to move the lock-operating member. When the balls are brought into horizontal alignment to form a straight-line chain, the distance from one end of the chain to the other is sufficient to provide the lock-opening force which moves the lock-operating member to its lock-opening position, the end ball of the straight-line chain bearing directly on the lock-operating member.

It is an object of the present invention to provide a cylinder lock of the character described which also includes safety means which prevents the lock-operating member from being moved to its lock-opening position when the group of balls have not been brought into horizontal alignment by insertion of the proper key in the lock. Such safety means is thus effective to prevent the lock-operating member from being moved to the lock-opening position by vibration or tampering.

Another object of the invention is the provision of a cylinder lock of the character described in which the safety means is normally biased to lock the lock-operating member rigidly in its first position in which the lock is closed, and in which, when the proper key is brought to its fully inserted position, the chain of horizontally-aligned balls exert a force upon the safety means to move the latter to a position in which it releases the lock-operating member for movement of the latter to its lock-opening position.

Another object of the present invention is to provide a pickproof lock which also includes means for positively moving the lock-operating member bact to its first, lock-closed position as the key is withdrawn from the lock, thus insuring that the lock-operating member cannot remain in lock-opening position after the key is withdrawn.

Another object of the invention is the provision of a pickproof lock of the character described in which the key forms part of the means for moving the lock-operating member back to its locking position, the key being specially constructed with a recess for receiving the end of a movable pin which bears against the lock-operating member, and a ramp which provides a cam action upon said pin as said key is withdrawn, whereby to press the lock-operating member to its locking position.

In accordance with the invention there is provided a pickproof lock comprising a body having a longitudinally-extending key slot therein, a lock-operating lever mounted in the body for movement between a normal locking position and a second position which it must occupy before the lock can be released a key sized for insertion in the key slot and movable to a fully-inserted position therein, a plurality of key-actuatable members, preferably tumbler pins, movably mounted in the lock body for sliding movement toward and away from said key slot and normally urged to positions in which portions thereof are engageable by said key inserted in said key slot, the members being movable to predetermined unlocking positions by the key in its fully-inserted position, and a lock-release element carried by each of the key-actuatable members and normally maintained by the latter in inoperative positions in which the lock-release elements are out of operative association with each other. When the key-actuatable members are brought to their unlocking positions, they bring the lock-release elements into operative engagement with each other, each element exerting a force upon the adjacent elements and said force being transmitted to the lock-operating lever in a direction to move the latter to its second position.

The lock also includes lock means which are normally urged to a position in which it engages and holds said lock-operating lever rigidly in its normal blocking position against movement to its second position. The locking means are engageable by said lock-release elements when the latter are in operative engagement with each other, whereby the force of the lock-release elements is transmitted to the locking means to move the latter to a position in which it releases the lock-operating lever for movement of the latter to its second position.

In a preferred embodiment, a pin is slidably mounted and is in engagement with the lock-operating lever. The pin has a terminal portion which extends into the keyway slot and is contained within a recess in the fully-inserted key. As the key is withdrawn from the lock, a cam surface bordering said recess engages the terminal portion of the pin and moves the pin toward the lock-operating lever in such a manner as to push the lever to its locking position when the key is withdrawn.

Additional objects and advantages of the invention will become apparent during the course of the following specification when taken in connection with the accompanying drawings, in which:

FIG. 1 is a perspective view of an assembled lock made in accordance with the invention;

FIG. 2 is an enlarged sectional view taken along the line 2—2 of FIG. 1;

FIG. 3 is a sectional view similar to FIG. 2, but showing the positions of the lock elements when the proper key is inserted and the lock is in the opeen condition;

FIG. 5 is a perspective view of the key shown in FIG. 3;

FIG. 6 is an enlarged view of a portion of FIG. 2;

FIG. 7 is an enlarged view of a portion of FIG. 3;

FIG. 8 is a sectional view taken along the line 8—8 of FIG. 6; and

FIG. 9 is a sectional view taken along the line 9—9 of FIG. 7.

Figure 4:
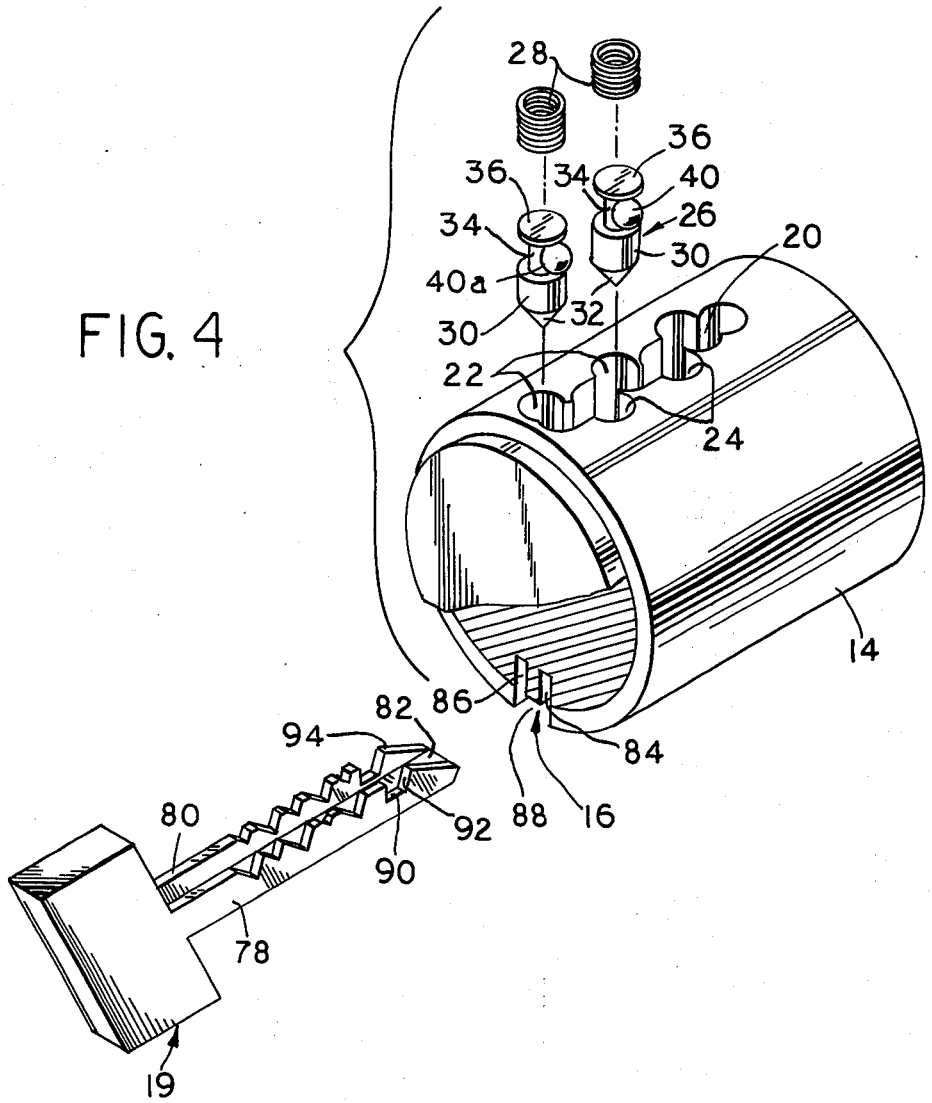
FIG. 4 is an exploded view of the cylinder and associated parts of the lock shown in FIG. 1.

Referring in detail to the drawings, there is shown in FIG. 1 a preferred embodiment of a lock 10 made in accordance with the present invention. The lock 10 comprises a hollow cylindrical casing 12 within which is mounted a lock cylinder 14.

The lock cylinder 14 has in its front wall a keyhole 16 communicating with a longitudinal keyway slot 18 into which a key 19 (FIG. 5) may be inserted. In contrast to conventional tumbler locks, the keyhole 16 and keyway slot 18 are not centrally located in the lock cylinder 14 but rather are offset from the center and are located adjacent the cylindrical surface of the lock cylinder 14 at one side thereof. In the locked condition of lock 10, shown in FIG. 2, the keyhole 16 is located adjacent the underside of lock cylinder 14.

Formed in the cylinder 14 is a longitudinal slot 20 which opens through the side of the cylinder opposite the keyway 18. The sides of slot 20 are parallel to one another and to the central axis of cylinder 14, and are spaced equal distances from said axis. the length of said slot 20 is somewhat less than the entire length of lock cylinder 14, and it extends downwardly through the body of lock cylinder 14 toward the keyway slot 18.

As shown in FIG. 4, a row of bores 22 is formed in the lock cylinder 14 along one longitudinal edge of the slot 20, and a second row of bores 24 is formed in the cylinder along the opposite longitudinal edge of slot 20. The bores 22 and 24 extend diametrically through the interior of cylinder 14 and communicate with the keyway slot 18.

In each of the bores 22 and 24, a tumbler pin 26 is slidably located, the pins being urged downwardly to the lower ends of the bores by respective coil springs 28. The lower ends of the springs 28 bear upon the respective pins 26, and the upper ends of the springs are seated against a retainer 29 which is secured in the otuer ends of the bores 22 and 24 and the mouth of slot 20 to close off the latter.

The pins 26 are each of identical construction, although their lengths are varied. Each pin 26 has a cylindrical body portion 30 having a rounded or tapered bottom end 32. Upstanding from the body portion 30 is a post 34 of narrow diameter (FIG. 4) terminating in an integral flat disc 36. The disc 36 and the flat upper surface of each pin body portion 30 provide a space or recess opening to the side of the pin for receiving and mounting a small metal ball 40 which is the prime element in the locking and unlocking of the lock. Each pin 26 mounts one of the balls 40 and in each instance, its ball is held against motion axially of the pin by its confinement in the recess in the side of the pin.

In the mounting of the pins 26 and balls 40, each ball is oriented so that it is confined between the post 34 of its associated pin and the wall of slot 20 remote from said post. The balls are thus held with their centers in a common plane parallel to the longitudinal axis of the lock cylinder 14. The slot 20 is shaped annd proportioned to hold the balls 40 in longitudinal alignment but also to allow a slight degree of transverse movement of the balls 40 relative to each other, in a manner to be explained presently.

As previously indicated, the pins 26 are of different lengths, this being accomplished by selectively varying the lengths of the pin body portions 30, as is best shown in FIGS. 2 and 3, the posts 34 and discs 36 all being of identical dimension. When no key is present in the lock 10, the pins 26 are spring-urged downwardly through their respective bores 22 to designated inner positions at which their tapered inner ends 32 are located at the same level within the keyway slot 18, as shown in FIG. 2. In this position of the pins 26, the balls 40 are located at different distances from the keyway 18.

The foregoing arrangement of the bores 22, pins 26 and balls 40 is generally similar to the arrangement described in my prior U.S. Pat. application Ser. No. 388,428, and reference is made thereto for further disclosure.

The lock cylinder 14 terminates in a circular end plate 42 which is secured to an external latch member 43. When the lock cylinder 14 is rotated, it rotates the end plate 42 which in turn moves the latch member 43 to open the external latch mechanism. When the lock 10 is closed, the cylinder 14 is locked to the hollow casing 12 by a lock-operating lever 44 which is mounted by a pivot 46 within the lock cylinder 14. The lock-operating lever 44 has a projecting upper portion 48 which, in the locked position shown in FIGS. 2 and 6, extends through a slot 50 in the lock cylinder 14 and into a registering slot 52 in the casing 12, thus blocking rotation of the lock cylinder 14. The lock-operating lever 44 has a bore 54 within which is mounted a helical spring 56 and a retaining pin 58. The spring 56 biases the retaining pin 58 in a downward direction through bore 54, so that the rounded tip 60 of pin 58 bears against the inner surface 63 of cylinder 14, thus normally urging the lock-operating lever 44 to pivot to the locked position shown in FIGS. 2 and 6. The retaining pin 58 is formed with a circumferential slot or groove 62 which cooperates with a leaf spring 64 to lock the lock-operating lever 44 in a manner to be described presently.

The leaf spring 64 is of L-shaped configuration, having an elongated flat arm 66 terminating at one end in a depending arm 68 which forms an angle of slightly less than 90° with the elongated arm 66. The arm 66 is slidably mounted within a slot 70 formed in the lower portion of the lock-operating lever 44. The depending arm 68 of leaf spring 64 extends along the forward surface 72 of the lock-operating lever 44.

The lock 10 is opened, upon insertion of a proper key therein, by interaction of the balls 40 which are carried by the tumbler pins 26. In the locked condition, the balls 40 are held by the spring-loaded pins 26 in inactive positions in which they are at different horizontal levels, as shown in FIG. 2. The lock-operating lever 44 is in its locking position with its upper portion 48 located within slot 52 of casing 12 and therefore prevents the cylinder 14 from turning relative to said casing. The distance between the first and last balls in the row of non-aligned balls 40 is insufficient to pivot the lock-operating lever 44 out of its locking position.

When the proper key is inserted in the lock to the fully-inserted position shown in FIG. 3, the balls 40 are raised by pins 26 into a horizontally-aligned chain or link of increased length. The end ball 40b, in engagement with the lock-operating lever 44 above its pivot 46, turns the lever 44 in a counterclockwise direction, as shown in FIGS. 3 and 7, to a lock-open position in which the upper portion 48 moves out of slot 52 and out of engagement with casing 12, and the cylinder 14 is released for rotation.

The leaf spring 64 serves as a safety device which insures that the cylinder 14 will be maintained in locked condition until the balls 40 are brought into proper alignment, in the following manner:

As shown in FIG. 6, the forward surface 72 of the locking lever 44 is formed with a recessed portion 74 underlying the depending arm 68 of the leaf spring 64. The angle formed between the leaf spring arms 66 and 68 is such that the depending arm 68 is inclined downwardly and rearwardly from its top end to its lower end which engages the lock-operating lever 44. Consequently, the upper end of the depending arm 68 is spaced an appreciable distance from the forward surface 72 of lever 44, as shown in FIG. 6, and the intermediate portion of the arm 68 is also spaced from the recessed portion 74 of lever 44. As shown in FIG. 8, the flat upper arm 66 of leaf spring 64 has a longitudinal edge 66*a* which faces the retaining pin 58 and is located to extend into the circumferential groove 62 of said pin 58, thereby normally holding said pin securely in its lowered position of FIG. 6, and preventing the lock-operating lever 44 from turning out of its locked position. Formed in the longitudinal edge 66*a* is an arcuate recess 76 of a diameter slightly larger than the diameter of pin 58. When the leaf spring arm 66 is slid through the slot 50 of lock-operating lever 44 in a right-hand direction, as shown in FIGS. 6 and 8, the arcuate recess 76 is brought into registry with retaining pin 58, and the latter is released so that it can move upwardly in bore 54, as shown in FIGS. 7 aand 9, thereby freeing the lock actuating lever 44 for pivoting movement to its lock-release position.

Thus, when the lock-actuating lever 44 is in its locking position of FIGS. 2 and 6, and the balls 40 are in non-aligned, staggered condition, the longitudinal edge 66*a* of leaf spring arm 64 is located in the circumferential groove 62 of retaining pin 58, thus locking the pin 58 rigidly in extended position, and in turn locking the lock-actuating lever 44 in its locking position. This adds to the security of the lock by preventing turning movement of the lock-operating lever 44 to its lock-open position through vibration or tampering.

FIG. 5 shows the key 19 which is used to open the lock 10. Since the tumbler pins 26 are slidably mounted in the two rows of bores 22 and 24, to present two spaced rows of pins 26, in order to actuate these two rows of pins, the key 19 is made in double shank form. The key 19 is of U-shaped cross-section having a pair of parallel shanks 78 and 80 connected by a crosspiece 82. Each of the shanks 78 and 80 is selectively ground to provide the usual slots and ridges, or dwells and elevations which operate to raise the pins to various heights. The keyhole 16 is correspondingly shaped, having a pair of spaced slot sections 84 and 86 connected by a cross-slot 88. At its forward end portion, the key shank 78 is formed with a recess 90, the forward edge of which is defined by a ramp portion or inclined surface 92. The forward end of the key is also provided with an upwardly-inclined leading surface 94 which leads to ramp portion 92.

The lock cylinder 14 also includes a bore 96 within which a spring-loaded actuating pin 98 is slidably mounted. A coil spring 100 located in the bore 96 biases the pin 98 in an upward direction toward the lock-operating lever 44. The pin 98 has an enlarged head 102 at its upper end, the head 102 being tapered or rounded and projecting upwardly through an opening 104 in the inner surface of the lock cylinder 14 to bear against the lock-operating lever 44. The lower end of pin 98 projects through an opening 106 in the outer surface of cylinder 14, and extends into the keyway slot 18, as shown in FIGS. 2 and 6.

The lower surface of lock-operating lever 44 is formed with an arcuate detent portion 108 which is offset rearwardly from the pivot 46 and is sized to receive the rounded head 102 of pin 98. In the locked position of lock-operating lever 44, shown in FIG. 6, the coil spring 100 urges the pin 98 upwardly so that its head 102 seats in the detent portion 108. Spaced rearwardly of the detent portion 108 is a shallow detent portion 110 within which the head 102 of pin 98 seats when the lock-operating lever has been pivoted to its lock-open position of FIG. 7. The detent portions 108 and 110 are joined by a cam surface 112 on the lower surface of lock-operating lever 44.

When the proper key 19 is inserted in the keyhole 16 and slid through keyway slot 18, the inclined leading surfaces 94 of the key shanks 78 and 80 engage the tapered tips 32 of the tumbler pins 26 of each row and raise each pin 26 in the keyway slot. When the key 19 is fully inserted, the dwells and elevations on the key shanks 74 and 76 are in registry with the tapered tips of the pins 26 of each row, and elevate each pin to the proper level, the balls 40 being carried upwardly with each pin. FIG. 3 shows the operative or unlocked condition of the lock 10, in which the key 19 is fully inserted, and the elevated pins 26 have brought the balls 40 into straight-line registry with each other so that the balls are horizontally-aligned. To reach this aligned position, each of the balls 40, except the first or forward ball 40*a*, moves a short distance rearwardly, such rearward movement being permitted because of the loose reception of each ball between the disc 36 and the top surface of the body portion 30 of the respective pin 26. In the horizontally-aligned position of the balls 40, the first ball 40*a* is in engagement with a fixed internal wall portion 114 of lock cylinder 14, but each ball engages the adjacent ball at a circumferential point lying in a straight line through the centers of the balls. The distance between the forward surface of th first ball 40*a* and the rear surface of the last ball 40*b* is now considerably greater than the distance between these balls in the locked, inoperative position of FIG. 2. The balls 40, aided by the downward pressure of a spring 28 upon each ball, now form a solid, linear chain or link of increased length bearing against the cylinder wall 114 at one end, and against the leaf spring depending arm 68 and the underlying lock-operating lever 44 at the other end.

As the chain of balls 40 increases in length, it exerts a force in a direction parallel to the longitudinal axis of the cylinder 14, against the depending arm 68 of leaf spring 64, causing the arm 68 to flatten against the forward surface 72 of the lock-operating lever 72. This brings the top end of arm 68 against the lever surface 72, in the manner shown in FIG. 7, and moves the upper spring arm 66 rearwardly through slot 70 to a position in which the arcuate recess 76 is in registry with the body of pin 58, thereby releasing the pin 58 for sliding movement.

As the chain of balls 40 further increases in length, it exerts a longitudinal force, through the flattened leaf spring arm 68, upon the rear surface of the lock-operating lever 44 at a point well above the pivot 46. Since the retaining pin 58 is now released, the lock-operating lever 44 is turned in a clockwise direction about pivot 46 until it reaches the lock-open position of FIGS. 3 and 7, and the lock may now be opened by turning the cylinder 14. When the lever 44 turns to its lock-open position, the retaining pin 58 slides upwardly through bore 54 against the tension of coil spring 56. The depressed retaining pin 58 maintains spring 56 under compression, and when the key 19 is withdrawn from the lock and the balls 40 are moved by tumbler pins 26 to their non-aligned positions, the spring-loaded retaining pin 58 will turn the lock-operating lever 44 back to its locked position.

The recess 90 is so positioned on the key 19 that when said key is in its fully-inserted position within the lock, the recess 90 underlies the actuating pin 98 and is in registry therewith. When the lock-operating lever 44 is turned to its lock-open position of FIG. 7, its cam surface 112 overrides the head 102 of pin 98 and presses said pin downwardly through bore 96, with the bottom end portion of pin 98 extending within the recess 90 of key 19, as shown in FIG. 7. In the lock-open position, the head 102 of actuating pin 98 is located in the shallow recess 110 of lock-operating lever 44. When the key 19 is withdrawn from the lock, its ramp portion 92 bears against the lower end of pin 98 and cams said pin upwardly, the pin 98 exerting an upward force on the lower surface of lock-operating lever 44 well rearwardly of pivot 46, and thereby urging the lever 44 to turn in a counter-clockwise direction back to its locking position. This action of the withdrawn key 19 upon the actuating pin 98 insures that key cannot be withdrawn from the lock with the lock-actuating lever 44 remaining in the lock-open position. The biasing force of the spring-loaded retaining pin 58 is normally sufficient to pivot the lock-operating lever to its locking position when the key is withdrawn. However, if the retaining pin 58 becomes rusty or dirty and tends to jam against sliding movement, or its spring 56 becomes weakened, it is possible that the lock-actuating lever 44 will remain in its lock-open position after the key is withdrawn, so that the lock is still in open condition. This situation is prevented, however, by the interaction of the key ramp 92 upon acctuating pin 98, which applies a positive force to return the lock-actuating lever 44 to its locking position as the key is withdrawn.

It is to be understood that since the bores 22 and 24 are arranged in the lock cylinder 14 in two spaced longitudinal rows the pins 26 inserted in these bores 22 are likewise arranged in two corresponding rows. In the illustrated embodiment, as shown in FIG. 4, provision is made for four bores 22 (and thus four pins 26) in one row, and three bores 24 (and corresponding pins) in the other row, for a total of seven tumbler pins. If desired, the bores, and pins may be arranged in a single linear row, although it is preferred to provide two offset rows in order to decrease the overall length of the lock.

While a preferred embodiment of the invention has been shown and described herein, it is obvious that numerous additions, changes and omissions may be made in such embodiment without departing from the spirit and scope of the invention.

What is claimed is:

1. A locking mechanism characterized by:

a body having a longitudinally-extending key slot therein;

a lock-operating lever pivotally mounted within the lock body for movement between a normal locking position and a second position which it must occupy before the lock can be released;

biasing means urging said lock-operating lever to its normal locking position;

a key sized for insertion into said key slot and movable to a fully-inserted position therein;

a plurality of key-actuatable members movably mounted within said body;

means urging said key-actuatable members toward positions in which portions thereof are engageable by said key when inserted in said key slot, and from which positions said key-actuatable members are movable to predetermined unlocking positions by said key in its fully inserted position;

a lock-release element carried by each of said key-actuatable members, said key-actuatable members having a normal lock-closed position in which said lock-release elements are maintained out of operative association with each other, said key-actuatable members in their unlocking positions retaining said lock-release elements in operative engagement with each other, with each element exerting a force upon the adjacent elements and said force being transmitted to said lock operating lever in a direction to move the latter to said second position;

releasable retaining means for rigidly locking said lock-operating lever in its normal locking position against movement to its second position, said retaining means being engageable by said lock-release elements when the latter are in operative engagement with each other, whereby the force of said lock-release elements is transmitted to said retaining means for moving the latter to a position in which it releases said lock-operating lever for movement of the latter to its second position.

2. A locking mechanism according to claim 1 in which said biasing means includes a retaining pin slidably mounted on said lock-operating lever and a spring pressing said retaining pin against a fixed portion of said body for urging said lock-operating lever to its normal locking position.

3. A locking mechanism according to claim 2 in which said releasable retaining means includes a slot in said retaining pin, and a leaf spring slidably mounted on said lock-operating lever, said leaf spring being normally biased to a position in which an edge portion thereof is contained within the slot of said retaining pin, said leaf spring also having a recess in said edge portion of greater size than the diameter of said retaining pin, said leaf spring being positioned to be engaged by said lock-release elements and moved by the latter to a release position in which said recess is in registry with said retaining pin.

4. A locking mechanism according to claim 1 which also includes actuating means for engaging said lock-operating lever and driving the latter to its normal locking position when the fully-inserted key is withdrawn from said key slot.

5. A locking mechanism according to claim 5 in which said actuating means includes an actuating pin slidably mounted in said body and having a first end facing said lock-operating lever and a second end communicating with said key slot.

6. A locking mechanism according to claim 5 in which said actuating means also includes means biasing said actuating pin into engagement with said lock-operating lever at such a position thereon that when said lock-operating lever is pivoted to its second position, it presses said actuating pin to an operative position in which the second end of said actuating pin projects within said key slot.

7. A locking mechanism according to claim 6 in which said actuating means also includes a recess portion on said key located to receive said second end of said actuating pin when said key is in its fully-inserted position in said key slot, and a cam surface on said key adjacent said recess portion.

8. A locking mechanism according to claim 7 in which the cam surface on said key is positioned to engage the second end of said actuating pin as said key is withdrawn from said key slot and to apply a bearing force upon said actuating pin in a direction to cause the latter to move said lock-operating lever to its normal locking position.

9. A locking mechanism according to claim 1 in which said body includes a cylinder rotatably mounted in a housing, said key-actuatable members comprise spring-biased pins slidably mounted in said cylinder, said lock-release elements comprise balls carried by said pins and being movable longitudinally of said cylinder relative the pins upon which they are mounted to form a linear link for transmitting said force to said lock-operating lever, and in which said lock-operating lever is pivotally mounted within said cylinder and has an extension portion projecting from said cylinder and engaging said casing for coupling said cylinder to said casing and restraining rotation of said cylinder when said lock-operating lever is in its normal locking position.

* * * * *